US007811127B2

(12) United States Patent
Tsuzaki et al.

(10) Patent No.: US 7,811,127 B2
(45) Date of Patent: Oct. 12, 2010

(54) SHIELD CONNECTOR FOR PRINTED CIRCUIT BOARD

(75) Inventors: Nozomi Tsuzaki, Susono (JP); Motoo Nojima, Tokyo (JP); Ryosuke Ii, Gotemba (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/411,890

(22) Filed: Mar. 26, 2009

(65) Prior Publication Data

US 2009/0247013 A1 Oct. 1, 2009

(30) Foreign Application Priority Data

Mar. 27, 2008 (JP) ..... 2008-083968

(51) Int. Cl.
*H01R 13/648* (2006.01)

(52) U.S. Cl. ..... 439/607.01

(58) Field of Classification Search ..... 439/607.01
See application file for complete search history.

(56) References Cited

U.S. PATENT DOCUMENTS 6,095,865 A * 8/2000 Wu ..... 439/607.01
6,461,200 B1 * 10/2002 Shi et al. ..... 439/676
6,923,689 B2 * 8/2005 Xue et al. ..... 439/676
7,241,157 B2 * 7/2007 Zhuang et al. ..... 439/188

FOREIGN PATENT DOCUMENTS

JP 2002-170640 A 6/2002

* cited by examiner

*Primary Examiner*—Tho D Ta
(74) *Attorney, Agent, or Firm*—Sughrue Mion, PLLC

(57) ABSTRACT

The present invention provides a shield connector for a printed circuit board, in which the disengagement of an outer shield shell from a connector housing is prevented, and also an anti-noise performance is enhanced. The shield connector includes a resin connector housing having a rectangular solid shape including a top-surface, a right-side-surface, a left-side-surface, a back-surface, and an opening; a terminal provided in the connector housing so as to be connected a connector through the opening; and a shield shell including a top-plate covering the top-surface, a right-side-plate covering the right-side-surface, a left-side-plate covering the left-side-surface, and a rear-plate covering the back-surface. The each of the right-side-surface and the left-side-surface includes an engagement portion positioned at the front lower end portion thereof, and each of the right-side-plate and the left-side-plate includes a hook positioned at the front lower end portion thereof and engaged with the engagement portion.

7 Claims, 7 Drawing Sheets

50
55
51
53
52
40
58
54a
41
42
52
54c
54b
58
54a
48
30
47
43
42
48
48c
48b
48a
48
58
54a

SHIELD CONNECTOR FOR PRINTED CIRCUIT BOARD

BACKGROUND

This invention relates to a shield connector for being mounted on a printed circuit board.

Generally, a shield connector for being mounted on a printed circuit board has a metallic shield shell covering an outer surface of a resin-made connector housing receiving terminals therein. The shield shell is electrically connected to a ground pattern on the printed circuit board, thereby electromagnetically shielding connecting portions of the connector terminals (see, for example, JP-A-2002-170640).

FIGS. 4 to 7 show such a related shield connector M1 for a printed circuit board, and FIG. 4 is a perspective view showing the appearance of the shield connector M1, FIG. 5 is a longitudinal cross-sectional view thereof, FIG. 6 is a perspective view showing a condition in which an outer shield shell is to be attached to an outer periphery of an outer housing, FIG. 7A is a side view of the shield connector, and FIG. 7B is a cross-sectional view taken along the line VIIb-VIIb of FIG. 7A, which is explanatory of problems with the shield connector.

As shown in FIG. 5, this shield connector M1 includes terminals 10 each bent into an L-shape (when viewed from the side), a resin-made inner housing 20 having the terminals 10 press-fitted therein (or insert molded therein), a metallic inner shield shell 30 of a tubular shape covering an outer periphery of the inner housing 20, the resin-made outer housing (corresponding to a connector housing) 140 having the inner shield shell 30 mounted therein, and the outer shield shell 150 covering the outer surface of the outer housing 140.

As shown in FIGS. 4 to 7, the outer housing 140 has a rectangular parallelepiped outer shape, and has a lower face 43 adapted to be placed on an upper surface of a printed circuit board (not shown). A fitting opening 47 (into which a mating connector is fitted) is formed in the front side of the outer housing 140, and a fitting lock portion 46 is formed on an inner surface of a front end of the fitting opening 47. When a housing of the mating connector is fitted into the outer housing 140, the fitting lock portion 46 locks this mating housing.

The terminal 10 is of the male type, and is press-fitted in the inner housing 20. The terminal 10 includes an electrical contact portion 11 whose distal end portion projects from the inner housing 20, and a proximal end portion of the terminal 10 is bent into an L-shape to form a lead portion 12 for connection to a circuit pattern on the printed circuit board (not shown). The lead portion 12 projects downwardly beyond the lower face 43 of the outer housing 140.

The inner shield shell 30 is mounted within the outer housing 140, with its tubular front portion 31 projecting into the fitting opening 47. The inner shield shell 30 is insulated from the terminals 10 by the inner housing 20 provided within the inner shield shell 30. A rear end portion of the inner shield shell 30 is disposed to cover the lead portions 12 of the terminals 10, and a ground terminal 32 for connection to a ground pattern on the printed circuit board is formed at the rear end of the inner shield shell 30.

The outer shield shell 150 has a generally inverted U-shape when viewed from the front side, and includes a top plate 51 covering an top surface 41 of the outer housing 140, a pair of right and left side plates 52 respectively covering right and left side surface 42 of the outer housing 140, and a rear plate 53 covering the rear side of the outer housing 140. The outer shield shell 150 is slid from the rear side of the outer housing 140, and is attached to the outer surface of the outer housing 140. A ground line connection portion 55 for forming a ground line is formed on the top plate 51 of the outer shield shell 150. Ground terminals 54*a* are formed respectively at lower edges of the right and left side plates 52, and also a ground terminal 54*b* is formed at a lower edge of the rear plate 53, these ground terminals 54*a* and 54*b* being adapted to be connected to the ground pattern on the printed circuit board. Retaining projecting piece portions 54*c* of the split type for retaining engagement with the printed circuit board are formed respectively at lower edges of rear portions of the right and left side plates 52.

A pair of slits 158 are formed respectively in the right and left side plates 52 of the outer shield shell 150 and extend in the back and forth direction, and also a pair of ribs 148 are formed respectively on the right and left side surface 42 of the outer housing 140 and extend in the back and forth direction. When slidingly attaching the outer shield shell 150 to the outer housing 140 from the rear side, the slits 158 are fitted respectively to the ribs 148 to guide the sliding movement of the outer shield shell 150.

When the shield connector M1 is assembled, the inner housing 20 having the terminals 10 press-fitted therein (or insert molded therein) is prepared, and the inner shield shell 30 is mounted on the inner housing 20, and then the inner shield shell 30 having the inner housing 20 received therein is inserted into the outer housing 140. Then, the outer shield shell 150 is slid onto the outer housing 140 from the rear side, and is attached thereto. At this time, the ribs 148 are fitted respectively in the slits 158, thereby guiding the sliding movement of the outer shield shell 150. When the outer shield shell 150 is completely attached to the outer housing 140, the mutually-fitted slits 158 and ribs 148 hold the outer shield shell 150 against upward movement, that is, prevent the outer shield shell 150 from being disengaged upwardly from the outer housing 140.

Thereafter, the shield connector M1 is placed on the printed circuit board, and the ground terminals 54*a* and 54*b* of the outer shield shell 150 are connected to the ground pattern on the printed circuit board, and the lead portions 12 of the terminals 10 are connected to the circuit pattern on the printed circuit board, thus completing the mounting of the shield connector M1 on the printed circuit board.

In the conventional shield connector M1 shown in FIGS. 4 to 7, the slits 158 are formed respectively in the right and left side plates 52 of the outer shield shell 150, and therefore there is a problem that the stiffness of the outer shield shell 150 against deformation is small. Namely, the slits 158 extend respectively from the front edges of the right and left side plates 52 of the outer shield shell 150, and therefore the right and left side plates 52 are liable to be resiliently bent or deformed outwardly (as indicated by arrows A) in the right-left direction away from each other as shown in FIG. 7B. When this opening deformation occurs and the slits 158 are disengaged from the respective ribs 148, there is a possibility that the outer shield shell 150 is disengaged upwardly (in a direction of arrow B) from the outer housing 140. Therefore, the handling of the assembled shield connector M1 requires attention until it is mounted on the printed circuit board, and this is cumbersome. In addition, since the opening-like slits 158 are formed in the outer shield shell 150, an electromagnetically-shielding area of this outer shield shell 150 is reduced by an amount corresponding to the areas of the slits. Therefore, the shielding ability is deteriorated, and an anti-noise performance is deteriorated, and as a result it is worried that a high-speed transmission performance and others may be affected.

SUMMARY

This invention is made in view of the above circumstances, and an object of the invention is to provide a shield connector for a printed circuit board, in which the disengagement of an outer shield shell from a connector housing is prevented, and also an anti-noise performance is enhanced.

A shield connector of the present invention includes a resin connector housing having a rectangular solid shape including a top-surface, a right-side-surface, a left-side-surface, a rear side, and an opening, a terminal provided in the connector housing so as to be connected a connector through the opening, and a metal shield shell slidingly attached to the connector housing and including a top-plate covering the top-surface, a right-side-plate covering the right-side-surface, a left-side-plate covering the left-side-surface, and a back-plate covering the rear side. Each of the right-side-surface and the left-side-surface includes an engagement portion positioned at the front lower end portion thereof, and each of the right-side-plate and the left-side-plate includes a hook positioned at the front lower end portion thereof and engaged with the engagement portion.

Preferably, the engagement portions are positioned at the corner of each of the right-side-surface and the left-side-surface.

Preferably, the hooks are positioned on an edge of each of the right-side-plate and the left-side-plate.

The engagement between the hook and the engage portion prevents the metal shield shell from opening deformation and disengagement from the connector housing in direction of top-surface. The engagement portion guides the sliding attachment of the metal shield shell With respect to the above described shield connector of the present invention, preferably, the engagement portions have a L-shape when viewed from a direction perpendicular to the top-surface, and includes an interconnecting portion projecting outwardly in a direction perpendicular to the corresponding side-surface, an engagement pin extending toward the back surface from a distal end of the interconnecting portion and having a lower surface, and a gap formed between the engagement pin and the corresponding side surface. Each of the hooks is inserted into the gap, and the lower surface of said engagement pin contacts an upper surface of the corresponding hook.

In the invention of claim 1, the outwardly-directed hooks are formed respectively at the lower front end portions of the right and left side plates of the shield shell, and also the engagement portions for receiving the respective hooks are formed respectively at the lower end portions of the front end portions of the right and left side faces of the connector housing. With this simple construction, there is no need to provide slits which would adversely affect the electromagnetic shielding ability, and therefore the shielding performance can be enhanced, and an anti-noise performance can be enhanced, so that a high-speed transmission performance can be secured. Furthermore, the guiding of the shield shell, as well as the holding engagement of the shield shell, is effected by the combination of the hooks (on the shield shell) and the engagement portions (on the connector housing), and this solves the problem that the shield shell may be disengaged from the connector housing.

In the invention of claim 2, each engagement portion has the generally L-shape when viewed from the upper side of the connector housing, and includes the interconnecting portion projecting outwardly in the right-left direction from the corresponding side face of the connector housing, and the engagement pin extending rearward from the distal end of the interconnecting portion such that the gap for receiving the corresponding side plate of the shield shell therein is formed between the side face of the connector housing and the engagement pin, and the lower surface of the engagement pin contacts the upper surface of the hook. Therefore, with this simple construction, the hooks can be positively brought into engagement with the respective engagement portions.

PREFERRED EMBODIMENT

A preferred embodiment of the present invention will now be described with reference to the drawings.

Figure 1:
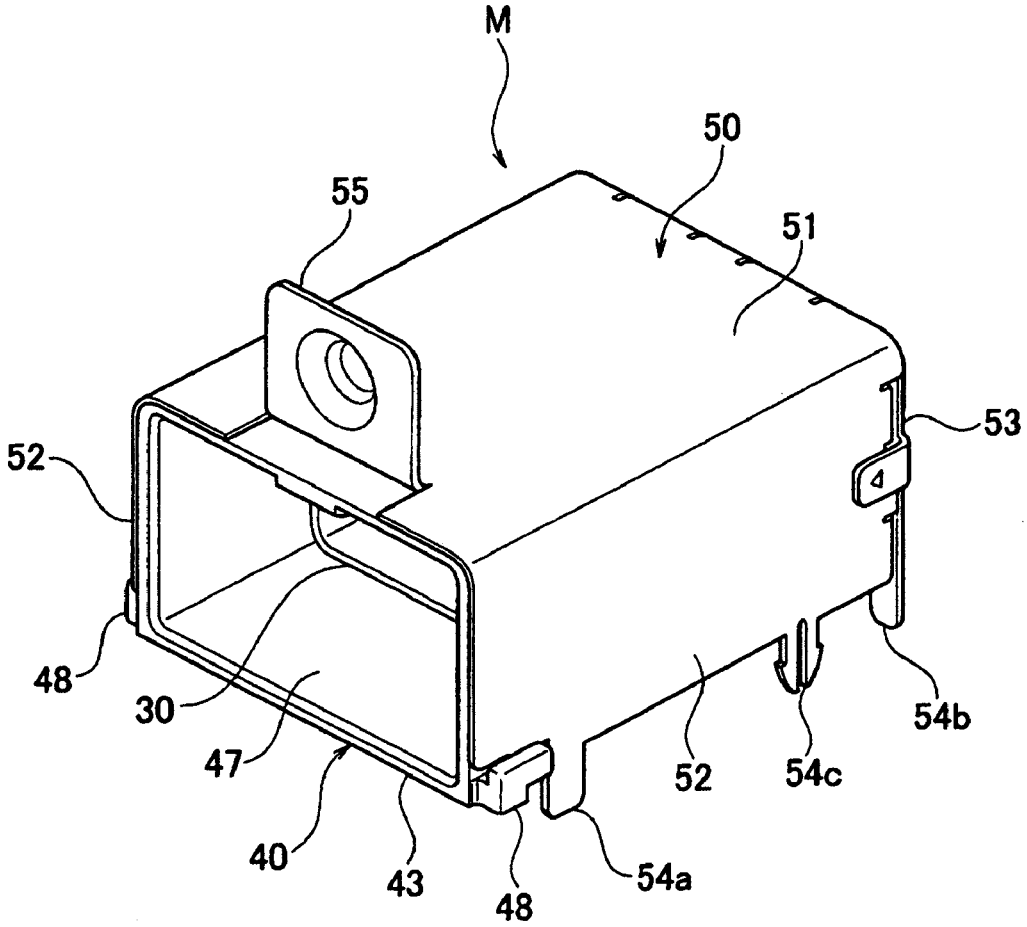
FIG. 1 is a perspective view showing a preferred embodiment of a shield connector of the present invention for a printed circuit board.
Figure 2:
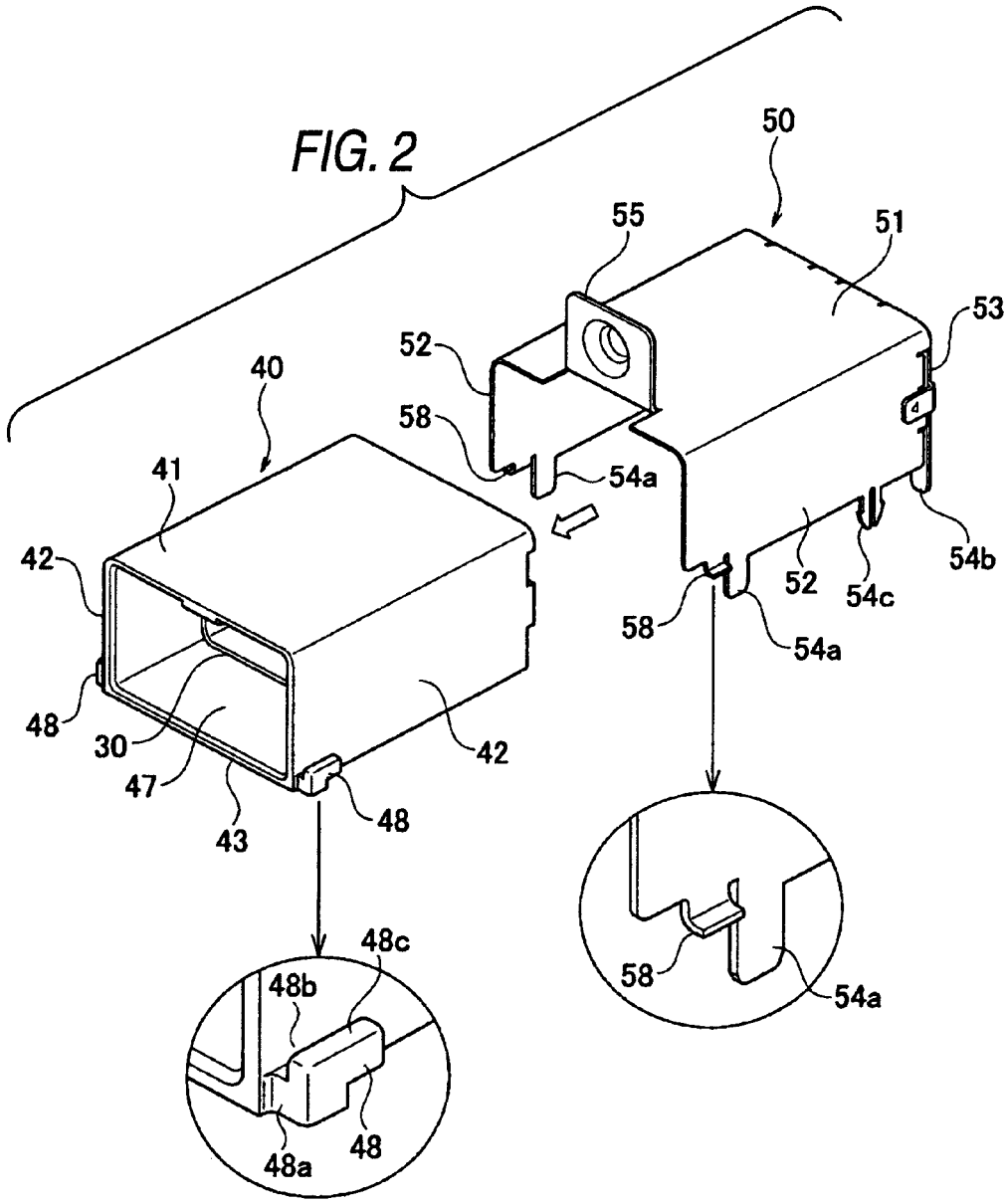
FIG. 2 is a perspective view of the shield connector and enlarged views of important portions thereof, showing a condition in which an outer shield shell is to be attached to an outer periphery of an outer housing from the rear side.
Figure 3A:
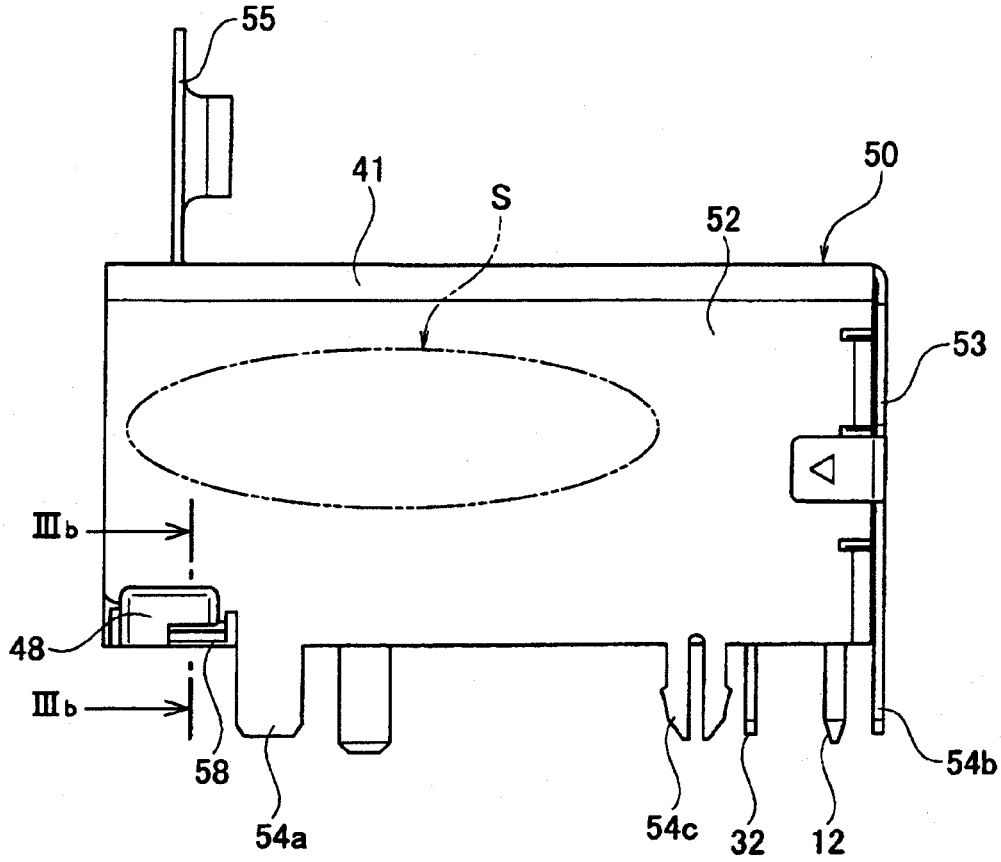
FIG. 3A is a side view of the shield connector.
Figure 3B:
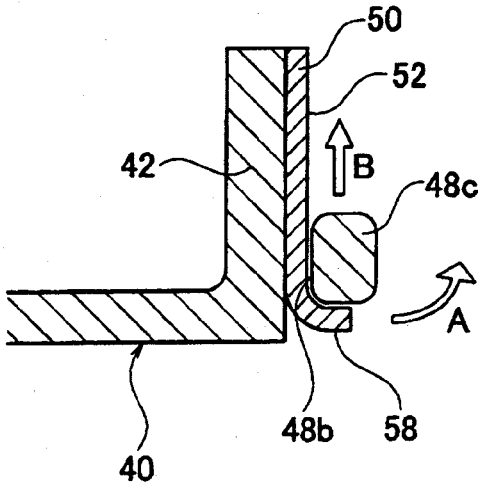
FIG. 3B is a cross-sectional view taken along the line IIIb-IIIb of FIG. 3A.
Figure 4:
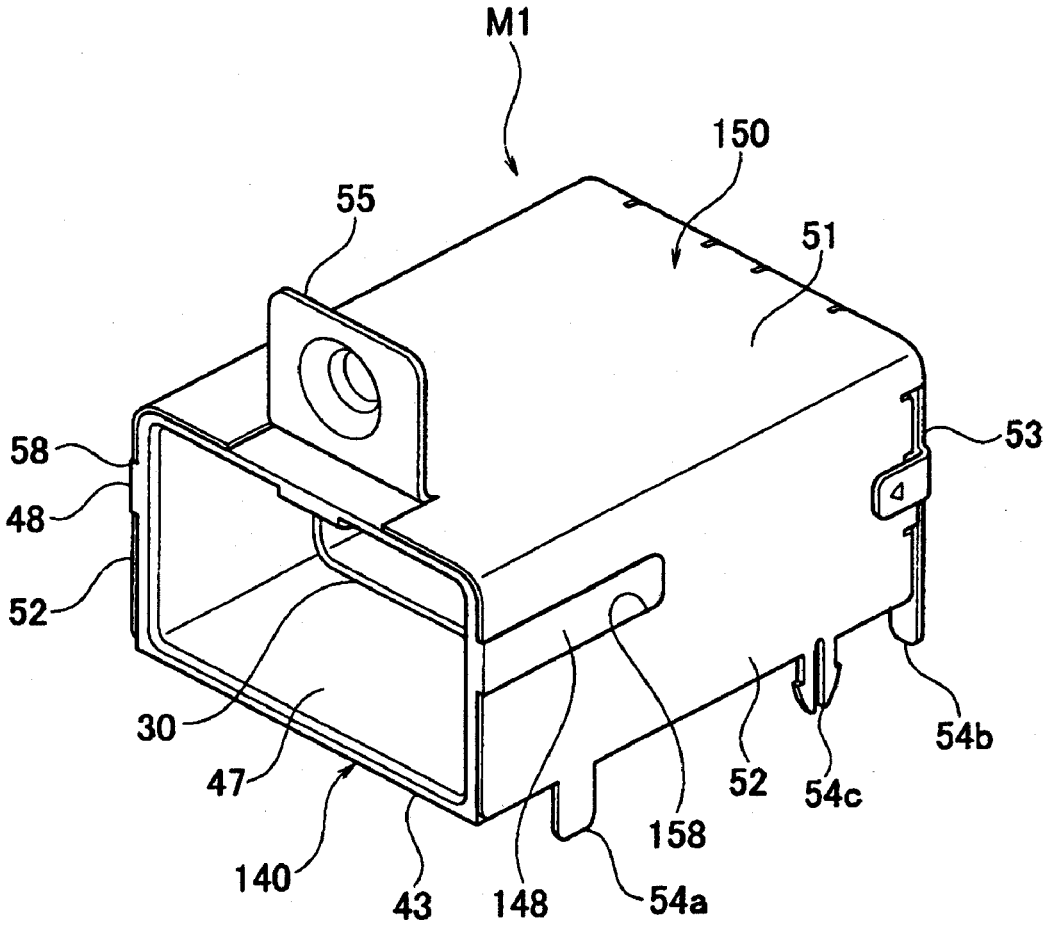
FIG. 4 is a perspective view showing the appearance of a conventional shield connector for a printed circuit board.

FIG. 1 is a perspective view showing the preferred embodiment of a shield connector of the invention for a printed circuit board, FIG. 2 is a perspective view of the shield connector and enlarged views of engagement portion and hook, showing a condition in which an outer shield shell is to be attached to an outer periphery of an outer housing from the rear side, FIG. 3A is a side view of the shield connector, and FIG. 3B is a cross-sectional view taken along the line IIIb-IIIb of FIG. 3A. As a longitudinal cross-sectional view of the shield connector is similar to that of FIG. 5, the longitudinal cross-sectional view of this embodiment is described also with reference to FIG. 5.

In the shield connector M of this embodiment, only the outer housing (corresponding to a connector housing) 40 and the outer shield shell (corresponding to a shield shell) 50 are different partly in construction from those of the related shield connector M1 shown in FIGS. 4 to 7, and therefore only such different portions will be described below in detail, and identical portions will be designated respectively by identical reference numerals, and explanation thereof will be omitted or simplified.

Figure 5:
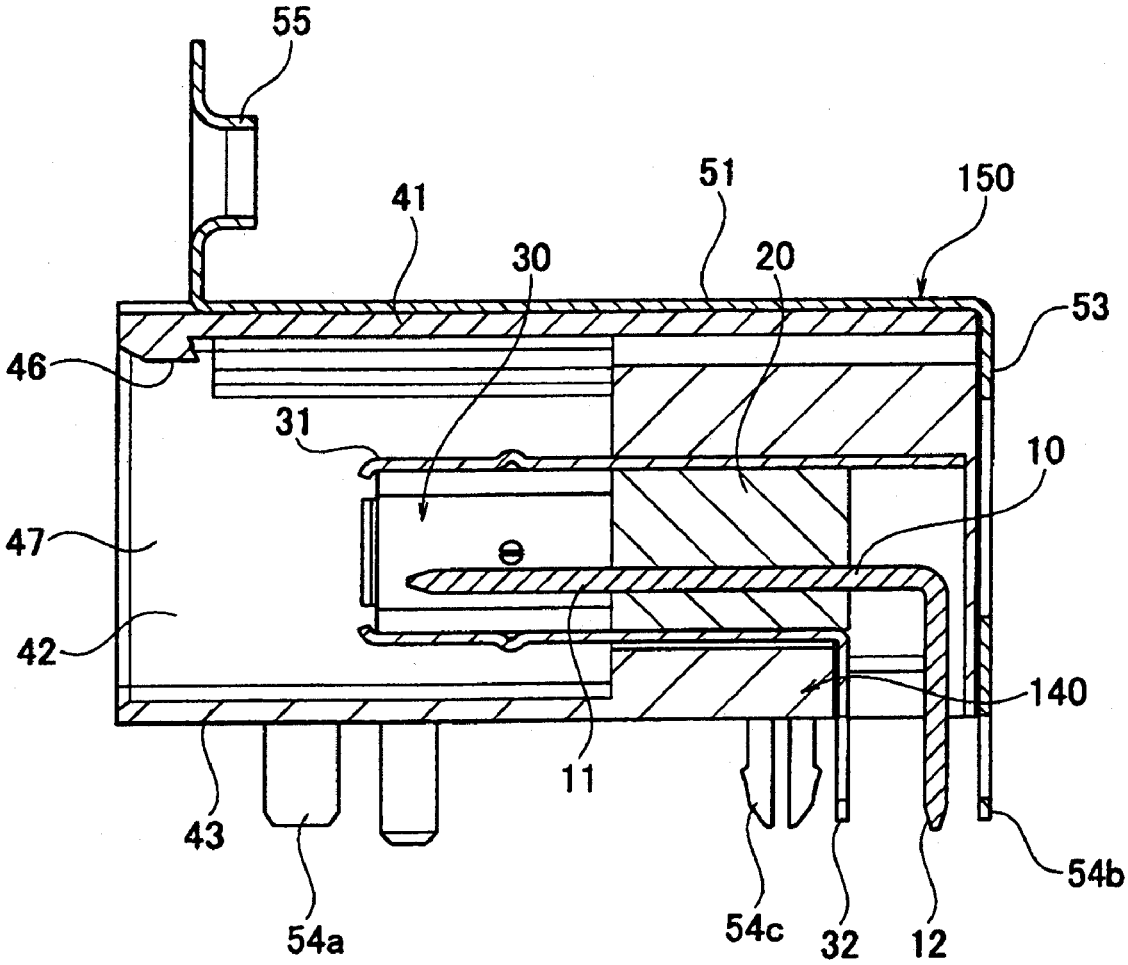
FIG. 5 is a longitudinal cross-sectional view of the conventional shield connector.
Figure 6:
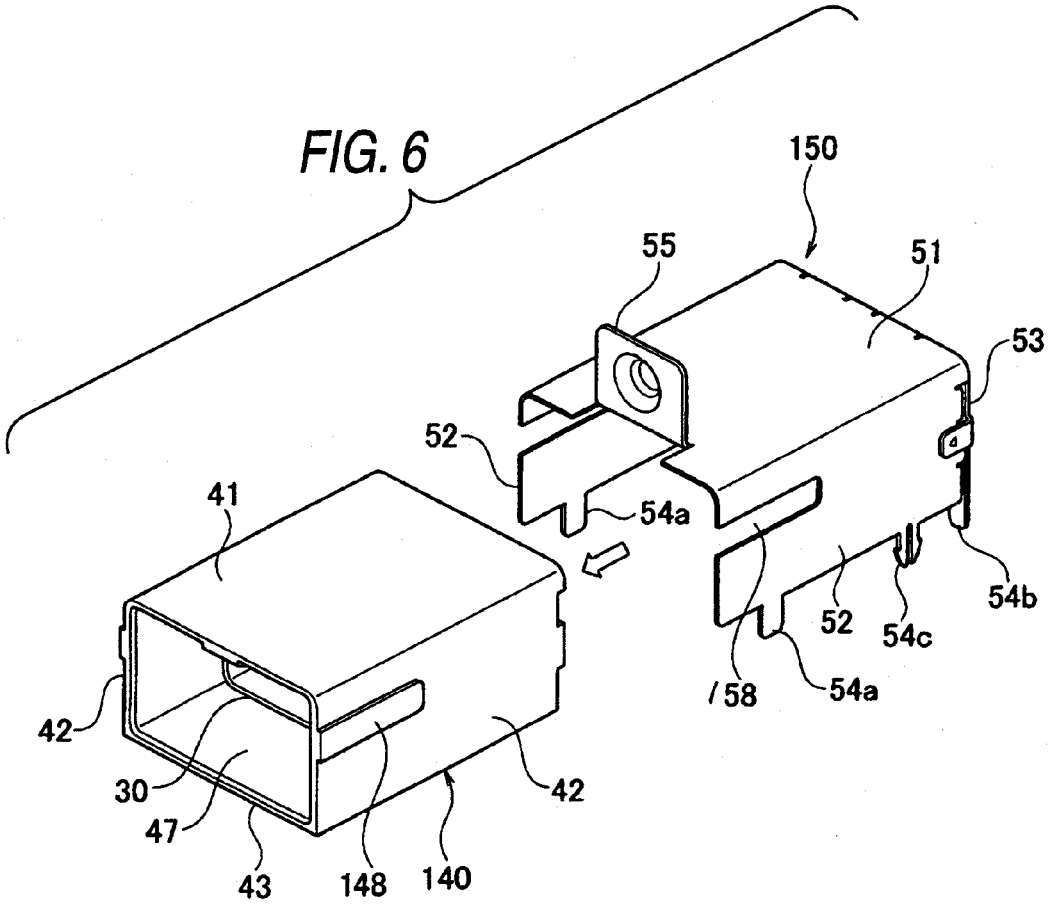
FIG. 6 is a perspective view of the conventional shield connector, showing a condition in which an outer shield shell is to be attached to an outer periphery of an outer housing.
Figure 7A:
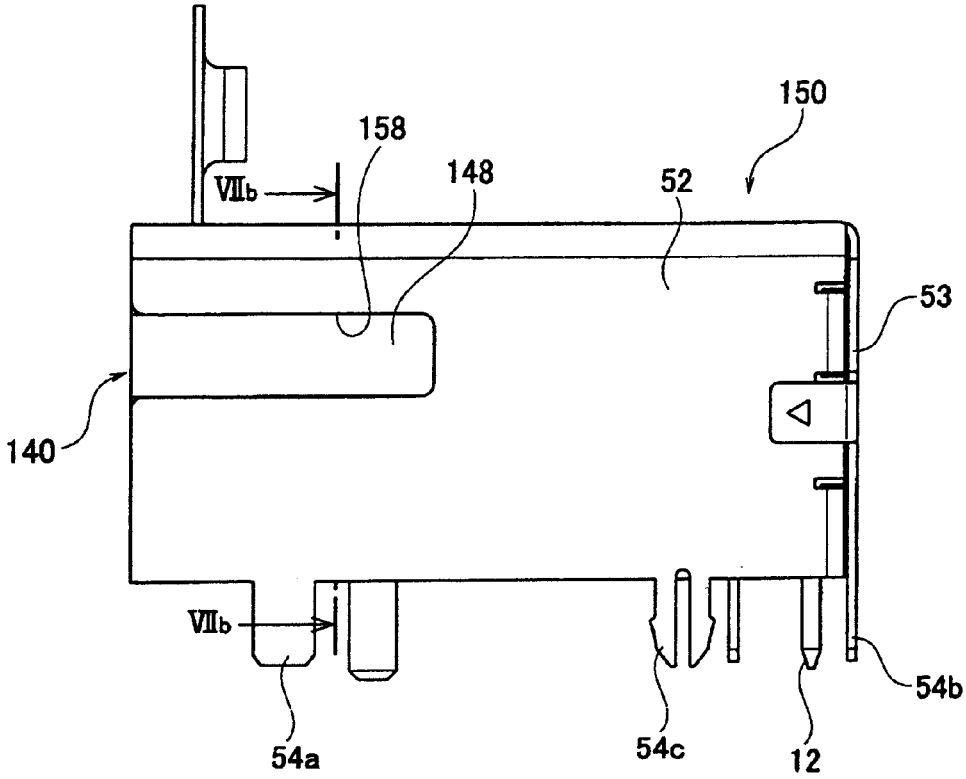
FIG. 7A is a side view of the shield connector.
Figure 7B:
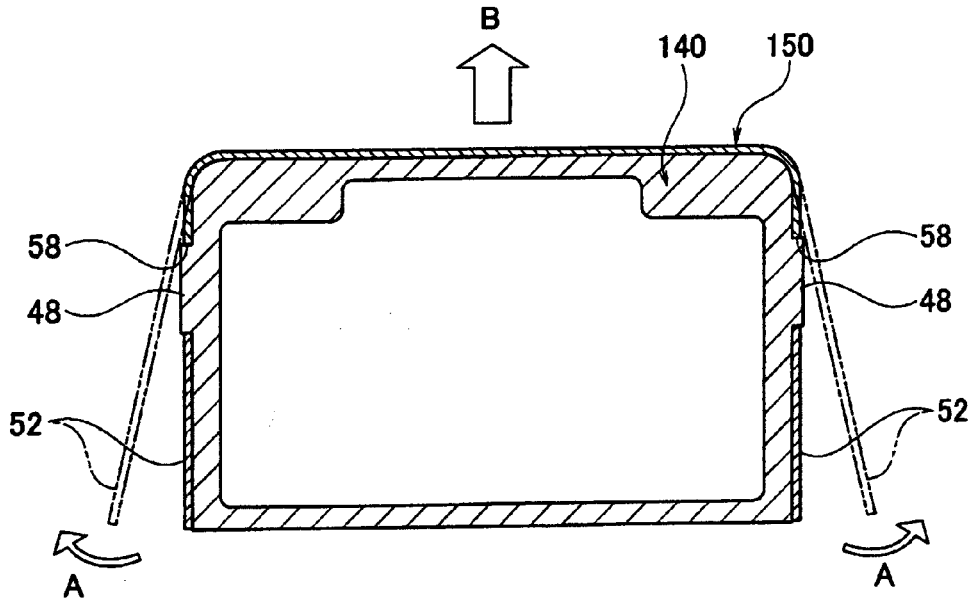
FIG. 7B is a cross-sectional view taken along the line VIIb-VIIb of FIG. 7A, which is explanatory of problems with the shield connector.

The shield connector M includes terminals 10, a resin-made inner housing 20 having the terminals 10 press-fitted (or insert molded) therein, a metallic inner shield shell 30 of a tubular shape covering an outer periphery of the inner housing 20 (With respect to the terminals 10, the inner housing 20 and the inner shield shell 30, see FIG. 5), the resin-made outer housing 40 having the inner shield shell 30 mounted therein, and the metallic outer shield shell 50 covering an outer surface of the outer housing 40, as shown in FIGS. 1 to 3.

The outer housing 40 has a rectangular parallelepiped outer shape, and has a lower face 43 adapted to be placed on an upper surface of a printed circuit board (not shown). A fitting opening 47 (into which a mating connector is fitted) is formed in a front side of the outer housing 40.

The outer shield shell 50 has a generally inverted U-shape when viewed from the front side, and includes a top plate 51 covering an top surface 41 of the outer housing 40, a pair of right and left side plates 52 respectively covering right and left side surface 42 of the outer housing 40, and a rear plate 53 covering the rear side of the outer housing 40. The outer shield shell 50 is slid relative to the outer housing 40 from the rear side thereof, and is attached to the outer surface of the outer housing 40.

A pair of hooks 58 serving as stabilizers are formed respectively on the right and left side plates 52 of the outer shield shell 50, and also a pair of engagement portions 48 are formed respectively on the right and left side surface 42 of the outer housing 40. When slidingly attaching the outer shield shell 50 to the outer housing 40 from the rear side, the hooks 58 are fitted respectively to the engagement portions 48, thereby guiding the sliding movement of the outer shield shell 50.

The hooks 58 are formed respectively at lower edges of front end portions of the right and left side plates 52 of the outer shield shell 50, and are bent to project outwardly (in a right-left direction) away from each other. The engagement portions 48 are formed respectively at lower end portions of front end portions of the right and left side surface 42 of the outer housing 40.

When the outer shield shell 50 having the right and left side plates 52 and the hooks 58 slides relative to the outer housing 40, the engagement portions 48 guide the attaching movement of the outer shield shell 50 from the rear side of the outer housing 40 toward the front side thereof, and also these engagement portions 48 are brought into engagement with the respective (right and left) side plates 52 and the respective hooks 58, thereby preventing the right and left side plates 52 from being resiliently bent or deformed outwardly in the right-left direction away from each other and also from upward movement. Each engagement portion 48 has a generally L-shape when viewed from the upper side of the outer housing 40.

Namely, each engagement portion 48 includes an interconnecting portion 48*a* projecting outwardly in the right-left direction from the corresponding side face 42 of the outer housing 40, and an engagement pin 48*c* extending rearward (that is toward the rear side of the outer housing 40) from a distal end of the interconnecting portion 48*a* such that a gap (or space) 48*b* for receiving the corresponding side plate 52 of the outer shield shell 50 therein is formed between the side face 42 of the outer housing 40 and the engagement pin 48*c*. A lower surface of the engagement pin 48*c* contacts an upper surface of the hook 58.

When the shield connector M is assembled, the inner housing 20 having the terminals 10 press-fitted therein (or insert molded therein) is prepared, and the inner shield shell 30 is mounted on the inner housing 20, and then the inner shield shell 30 having the inner housing 20 received therein is inserted into the outer housing 40. Then, the outer shield shell 50 is slid onto the outer housing 40 from the rear side, and is attached thereto. At this time, the lower end portions of the right and left side plates 52 of the outer shield shell 50 are inserted respectively into the gaps 48*b* formed respectively at the inner sides of the engagement pins 48*c*, with the upper surfaces of the hooks 58 sliding relative to the lower surfaces of the respective engagement pins 48*c*, as shown in FIG. 3B. By doing so, the sliding movement of the outer shield shell 50 is guided.

When the outer shield shell 50 is completely attached to the outer housing 40, the engagement pins 48*c* are completely engaged with the hooks 58, respectively, and prevent the respective (right and left) side plates 52 of the outer shield shell 50 from being resiliently bent or deformed outwardly (as indicated by arrow A in FIG. 3B) away from each other, and also hold the respective side plates 52 against upward movement (in a direction of arrow B).

Thereafter, the shield connector M is placed on the printed circuit board, and ground terminals 54*a* and 54*b* of the outer shield shell 50 are connected to a ground pattern on the printed circuit board, and lead portions 12 of the terminals 10 are connected to a circuit pattern on the printed circuit board, thus completing the mounting of the shield connector M on the printed circuit board.

As described above, in the shield connector M of this embodiment, the outwardly-directed hooks 58 are formed respectively at the lower edges of the front end portions of the right and left side plates 52 of the outer shield shell 50, and also the engagement portions 48 for receiving the respective hooks 58 are formed respectively at the lower end portions of the front end portions of the right and left side surface 42 of the outer housing 40. Therefore, slits which would adversely affect the electromagnetically-shielding ability as in the conventional construction do not need to be provided in main portions (that is, areas indicated by S in FIG. 3A) of the right and left side plates 52 of the outer shield shell 50. Therefore, the shielding performance can be enhanced, and an anti-noise performance can be enhanced, so that a high-speed transmission performance can be secured. Furthermore, when attaching the outer shield shell 50 to the outer housing 40, the guiding of the outer shield shell 50, as well as the holding engagement of the outer shield shell 50, is effected by the combination of the hooks 58 (on the outer shield shell 50) and the engagement portions 48 (on the outer housing 40), and this solves the problem that the outer shield shell 50 may be disengaged from the outer housing 40.

Furthermore, each engagement portion 48 has the generally L-shape when viewed from the upper side of the outer housing 40, and includes the interconnecting portion 48*a* projecting outwardly in the right-left direction from the corresponding side face 42 of the outer housing 40, and the engagement pin 48*c* extending rearward from the distal end of the interconnecting portion 48*a* such that the gap 48*b* for receiving the corresponding side plate 52 of the outer shield shell 50 therein is formed between the side face 42 of the outer housing 40 and the engagement pin 48*c*, the lower surface of the engagement pin 48*c* contacting the upper surface of the hook 58. Therefore, with this simple construction, the hooks 58 can be positively brought into engagement with the respective engagement portions 48.

What is claimed is:

1. A shield connector comprising:

a resin connector housing having a rectangular solid shape including a top-surface, a right-side-surface, a left-side-surface, a back-surface, and an opening;

a terminal provided in the connector housing so as to be connected to a connector through the opening in a connector fitting direction; and a metal shield shell slidingly attached to the connector housing and including a top-plate covering the top-surface, a right-side-plate covering the right-side-surface, a left-side-plate covering the left-side-surface, and a rear-plate covering the back-surface, wherein each of the right-side-surface and the left-side-surface includes an engagement portion positioned at the front lower end portion thereof, and each of the right-side-plate and the left-side-plate includes a hook positioned at the front lower end portion thereof and engaged with the engagement portion, wherein, as viewed in said connector fitting direction, said hook has an L-shape including a downwardly extending portion and an outwardly extending portion which respectively abut against two perpendicularly disposed surfaces of the engagement portion to prevent the right-side-plate and the left-side-plate from being deflected outwardly and to prevent the upward movement of the metal shield with respect to the resin connector.

2. The shield connector according to claim 1, wherein the engagement portions are positioned at the corner of each of the right-side-surface and the left-side-surface.

3. The shield connector according to claim 1, wherein the hooks are positioned on an edge of each of the right-side-plate and the left-side-plate.

4. The shield connector according to claim 1, wherein the terminal is connected to a print board.

5. The shield connector according to claim 1, wherein the engagement between the hook and the engage portion prevents the metal shield shell from opening deformation and disengagement from the connector housing in direction of the top-surface.

6. The shield connector according to claim 1, wherein the engagement portion guides the sliding attachment of the metal shield shell to the connector housing.

7. The shield connector according to claim 1, wherein the engagement portions have a L-shape when viewed from a direction perpendicular to the top-surface, and includes:

an interconnecting portion projecting outwardly in a direction perpendicular to the corresponding side-surface;

an engagement pin extending toward the back surface from a distal end of the interconnecting portion and having a lower surface; and a gap formed between the engagement pin and the corresponding side surface, wherein each of the hook is inserted into the gap, and the lower surface of said engagement pin contacts an upper surface of the corresponding hook.

* * * * *